US005501250A

United States Patent [19]

Edwards et al.

[11] Patent Number: 5,501,250

[45] Date of Patent: Mar. 26, 1996

[54] METHOD FOR DELETING AND REINTRODUCING YARNS TO A TEXTILE PROCESS

[75] Inventors: Donald W. Edwards; Peter Popper; David P. Rule; William C. Walker, all of Wilmington, Del.

[73] Assignee: E. I. Du Pont de Nemours and Company, Wilmington, Del.

[21] Appl. No.: 345,724

[22] Filed: Nov. 22, 1994

[51] Int. Cl.[6] ..... D03D 47/34

[52] U.S. Cl. ..... 139/450; 139/453

[58] Field of Search ..... 112/80.70, 80.08, 112/80.73, 80.07; 139/453, 450, 435.1

[56] References Cited

U.S. PATENT DOCUMENTS

| | | | |
|---|---|---|---|
| 3,595,185 | 7/1971 | Shorrock | 112/80.08 |
| 4,351,691 | 9/1982 | Schwartz . | |
| 4,531,385 | 7/1985 | Jacobsson . | |
| 4,549,496 | 10/1985 | Kile . | |
| 4,678,533 | 7/1987 | Bartlett et al. . | |
| 4,991,523 | 2/1991 | Ingram . | |
| 5,016,679 | 5/1991 | Cox | 139/450 |
| 5,080,028 | 1/1992 | Ingram . | |
| 5,165,352 | 11/1992 | Ingram | 112/80.08 |
| 5,329,962 | 7/1994 | Ohnishi et al. | 139/450 |

FOREIGN PATENT DOCUMENTS

| | | | |
|---|---|---|---|
| 1318226 | 5/1973 | United Kingdom | 112/80.08 |

*Primary Examiner*—Andy Falik

[57] ABSTRACT

Method to delete and reintroduce individual yarns as needed when they are being fed to a textile process by cutting an individual yarn, that is being forwarded to the process, rapidly to prevent producing a disruptive tension change in the process or in other yarns being forwarded to the process to produce an upstream cut end of an individual yarn; holding the upstream cut end of said individual yarn in an elongated condition at a ready position for reintroducing to the process; and reintroducing said yarn at said ready position to the textile process according to the following steps; metering said individual yarn from said source at a controlled rate; passing said cut end of yarn with a first individual yarn forwarding jet for forwarding said cut end from said ready position and maintaining said cut end of yarn in an elongated condition during said metering; directing said elongated, cut end of yarn in a path past an individual yarn cutter; passing for forwarding said elongated cut end of yarn from said cutter and along an individual yarn path, and maintaining said cut end of yarn in an elongated condition during said passing; and converging said elongated, cut end of yarn with a plurality of individual yarn paths for said plurality of yarns for forwarding said yarn to said textile process.

10 Claims, 4 Drawing Sheets

METHOD FOR DELETING AND REINTRODUCING YARNS TO A TEXTILE PROCESS

BACKGROUND OF THE INVENTION

This invention relates to a method for deleting and reintroducing individual yarns to a textile process wherein the method can feed any number and combination of yarns at any time.

Many fiber processes adjust the position of different yarns in a fabric to create special effects. For example, in hand-made tapestries, yarns of different colors are locked into precise locations to create highly detailed images. In machine-made fabrics, many techniques have been developed to vary the yarn at each point of the surface. The techniques, although varied, can be divided into two groups: processes which adjust the relative geometry of different feed yarns and processes which vary feed yarn at any time.

Weaving is a typical process which can adjust the relative geometry of different feed yarns. This can be illustrated by considering the example of weaving a red warp with a white filling. The fabric will appear red where the warp yarn passes over the filling and white elsewhere. Knitting and tufting can create the same effect by hiding or "burying" the unwanted yarns within the fabric and placing the desired yarns on the surface. This method of changing color has the inherent disadvantage of wasting yarn, particularly when some colors appear on the surface infrequently. In addition, this method limits the number of colors that can be used since only a limited amount of yarn can be hidden at each location.

Several processes utilize the method of changing feed yarn at different locations. In weaving, this is done by changing the filling yarn supply at different picks along the fabric. In computer controlled embroidery, the machine can be stopped and automatically restrung with a different color thread to create highly detailed patterns.

In tufting, special machinery has been developed to automatically switch feed yarns to tufting needles to create patterns in carpets. The process of this invention provides a new method of changing feed yarns which overcomes some of the inherent problems of the existing processes. It has the advantages of switching yarns without stopping the process and of feeding a number of yarns simultaneously.

SUMMARY OF THE INVENTION

This invention provides a new method of deleting and reintroducing individual yarns and combining multiple yarns while a textile process is running. It is particularly useful for creating patterns in carpets.

More particularly, the method deletes and reintroduces individual yarns of a plurality of yarns to a textile process producing textile articles and has the capability of feeding any number and any combination of a plurality of individual yarns at any time. The steps of the method are based on being able to rapidly cut down a yarn without stopping or disrupting the textile apparatus and individual yarns, and holding the cut end so it can be reintroduced. Reintroduction of the yarn comprises forwarding an individual yarn under tension from a supply source to a first jet for separately picking up and forwarding the individual yarn. This yarn is then directed past a cutter and through a guide and a jet means. The jet means may also comprise only an individual yarn forwarding jet (second jet), or only a common multiple yarn forwarding jet (third jet), or both an individual yarn forwarding jet and a common multiple yarn forwarding jet. In a preferred embodiment, a plurality of yarns supplied by second jets are converged in a third jet for forwarding to the textile process that forwards the yarn as the textile article is produced.

When a yarn is to be deleted from the process, it is cut by the cutter, and the forwarding step from the supply source is stopped. The apparatus is able to feed from one up to six or more different individual yarns simultaneously. In a preferred embodiment utilizing a hot wire cutter, the yarn is directed along a path of excess length adjacent the cutter to thereby accumulate a short length of yarn so the yarn can be slowed or stopped adjacent the cutter during the cutting process.

DETAILED DESCRIPTION OF THE INVENTION

Figure 1:
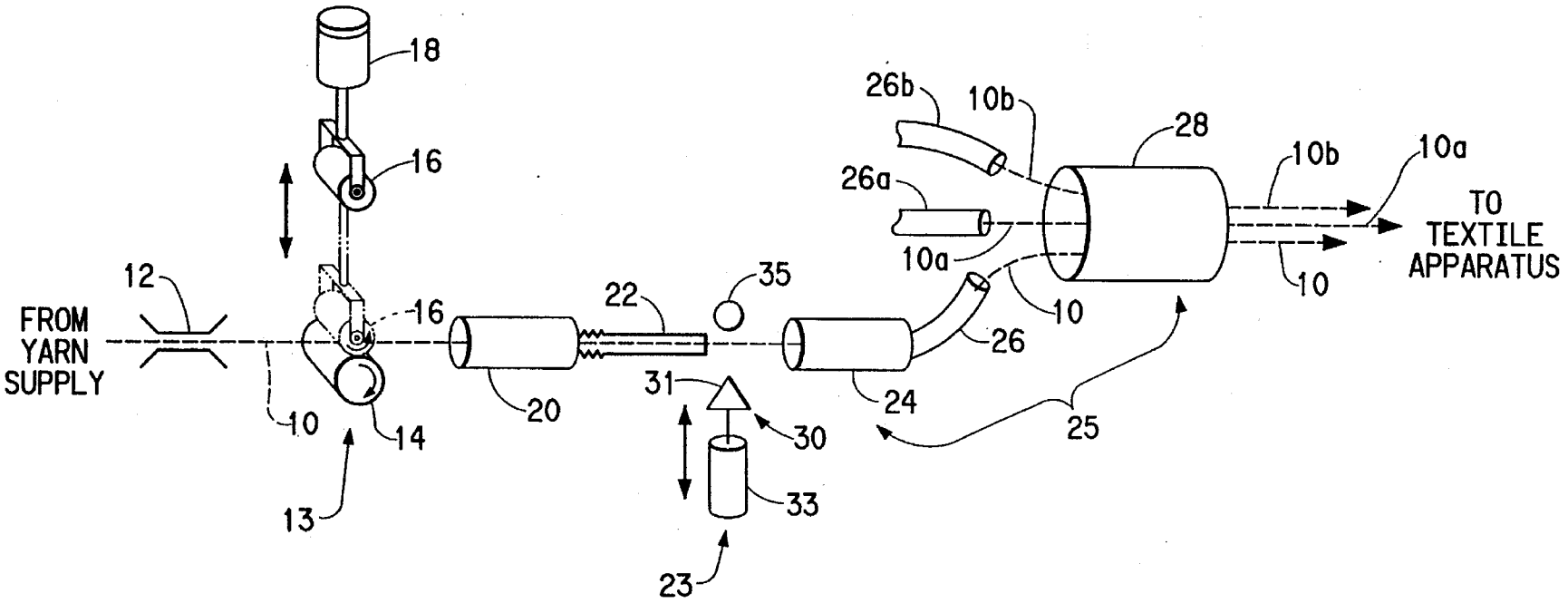
FIG. 1 is a perspective schematic view of apparatus embodying the invention.

FIG. 1 shows an embodiment of the invention for deleting any individual yarn and reintroducing any individual yarn of a plurality of individual yarns being fed under tension from a plurality of individual sources to a textile process without stopping or disrupting the textile process or the other individual yarns. This embodiment permits feeding any number and combination of the plurality of yarns to the process. In FIG. 1, the system is shown in detail for one yarn 10 of the plurality of yarns, such as yarns 10, 10*a*, and 10*b*. For an individual yarn, the system of FIG. 1 comprises a tensioning device 10, a metering device 13, a first individual yarn forwarding jet 20, a guide 22, an individual yarn cutting device 23, another guide 26 and a jet means 25 comprising a second individual yarn forwarding jet 24 and a common multiple yarn forwarding jet 28. When yarn 10 is running continuously to the textile apparatus as shown on FIG. 1, it is forwarded through the system by the textile apparatus, with optional assistance from the forwarding jets, and the system of the invention is waiting to perform the deleting (cutting) and reintroducing (adding) functions.

Yarn 10 comes from a yarn supply (not shown) and is passed through a tensioning device 12 and through a metering device 13 which comprises a continuously rotating roll 14, a nip roll 16, and a biasing device 18. Nip roll 16 presses yarn 10 against roll 14 when it is desired to begin metering yarn 10 from the source and through the tensioning device at a controlled rate. Otherwise, device 18 retracts nip roll 16 so that roll 14 no longer meters yarn.

Device 18 may be a piston, a spring, or any other device capable of positively biasing nip roll 16 against roll 14 and later retracting nip roll 16 from roll 14. Following roll 14, yarn 10 passes through first individual yarn forwarding jet 20, which urges the yarn forward and maintains the yarn, and particularly the cut end of yarn, in an elongated condition. Following jet 20, the yarn passes through guiding means 22 which may be a flexible tube, a rigid tube with bellows located between the ends, or a rigid tube.

Cutting device 23 includes a means 30 for rapidly cutting yarn 10. Means 30 may be a hot wire, a knife blade arrangement, a shear cutter arrangement, or the like. The cutting means 30 may also move toward yarn 10 when it is desired to cut the yarn. The cutting device shown in FIG. 1 comprises a knife blade 31 moveable by piston actuator 33 and a rotatable anvil cylinder 35 that can be periodically rotated to present a new surface to knife 31. The second individual yarn forwarding jet follows the cutter and serves to draw the leading end of cut yarn 10 away from the end of guiding means 22 when it is desired to reintroduce yarn 10 to the textile apparatus. From second forwarding jet 24, yarn 10 is fed through guide tube 26 and on to a third multiple yarn forwarding jet 28 where yarn 10 is combined with other yarns emerging from guide tubes 26*a*, 26*b*, etc. Up to six or more yarns may be fed to jet 28 in any combination or all simultaneously depending on the yarn properties, jet size, and air flow through the jet. Yarns emerging from third forwarding jet 28 are fed to the textile apparatus such as, but not limited to, a tufting machine, a loom, or the elongated pile article manufacturing apparatus disclosed in U.S. patent application Ser. No. 08/017,162, filed Feb. 22, 1993. Once engaged by the textile apparatus, the yarn is forwarded by the textile apparatus itself and the other forwarding jets may be disabled or may remain enabled to reduce tension buildup in the yarn.

In the preferred embodiment, each yarn fed to the textile apparatus would have its own tensioning device nip roll 16, nip roll biasing device 18, first forwarding jet 20, guiding means 22, cutting device 23, second forwarding jet 24, and guide tube 26. Roll 14 and third forwarding jet 28 may be common to all the yarns. Also, depending on such variables as yarn denier, number of yarns, jet design, and air pressure, jet 24 might be eliminated so that yarn 10 travels directly from guiding means 22 to jet 28 via guide tube 26. What would be required is that jet 28 work through the plurality of guide tubes 26 to pick up the individual yarns directed along individual paths past individual cutters 23 by the plurality of guide means.

Figure 4:
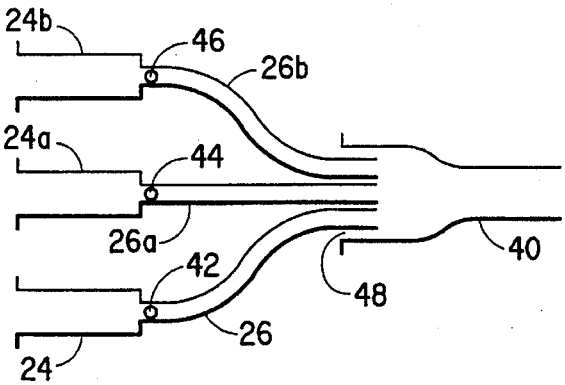
FIG. 4 shows an alternate embodiment of the jet means beyond the cutter.

Alternatively, the third jet 28 could be eliminated and the second jets 24 retained as shown in FIG. 4. In this embodiment, the guide tubes, such as individual yarn guide tubes 26, 26*a*, and 26*b*, would converge in a common multiple yarn guide tube 40 as shown. To ensure excess jet back pressure does not develop downstream of individual yarn forwarding jets, such as jets 24, 24*a*, and 24*b*, vent holes 42, 44, and 46 are provided in the jets respectively. These vent holes pass excess air flow from the jets if the back pressure in the guide tubes is too high for a particular set of conditions. Similarly, there is a clearance gap 48 where the converged tubes 26, 26*a*, and 26*b* enter guide tube 40 so excess flow due to back pressure in tube 40 can be vented. Without such vents, the elongated condition of the yarn may not be maintained and any excess back pressure may stop the forwarding and create a plug of tangled yarn; or any excess back pressure may momentarily blow the leading end of a cut yarn in a reverse direction in the guides or jets during reintroduction of the yarn to the textile apparatus. This venting technique may be useful with any of the jets used in any of the embodiments if back pressure downstream of the jet produces problems. When feeding an individual yarn end through the arrangement of FIG. 4, it may be useful to energize several or all of the jets 24, 24*a* and 24*b* when introducing an individual yarn to provide ample air flow through the common guide 40. In general, then, the yarn feeding device of the invention requires a first jet, a cutting means, and another jet means which may be one or the other or both of a second and a third jet.

If the textile apparatus can automatically engage the leading end of a cut yarn, the yarn handling device of the invention can operate with no running ends going through common jet 28 or common guide 40 when a yarn is to be introduced to the textile apparatus. If the textile apparatus is not able to automatically engage the leading end, then the yarn handling device can operate with at least one running yarn line; when a yarn is to be introduced, it may entangle with the running yarn line to become automatically engaged by the textile apparatus. The yarn handling device can add and delete any number of yarns to the textile apparatus when there are zero or a plurality of ends running to the textile apparatus. Experience has shown that as many as four ends of ply twisted BCF carpet yarn can be handled by the yarn feeding device and it is expected that six or more ends can be easily handled.

Figure 2A:
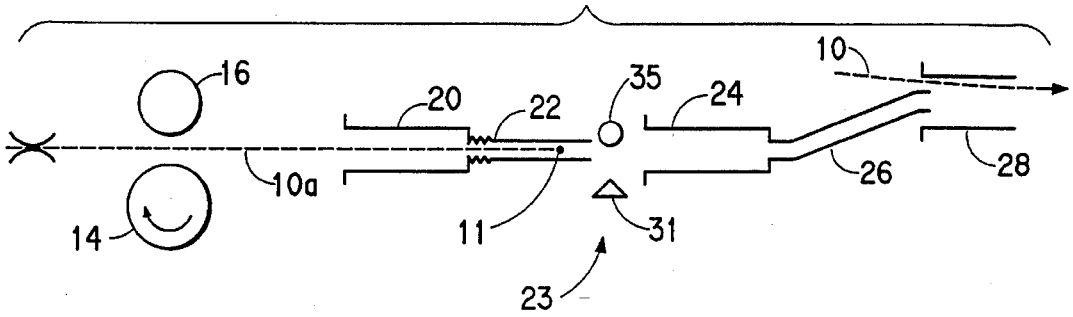
FIGS. 2A–2E schematically illustrate the method of adding new yarn(s) to yarns being fed to a textile operation and cutting rapidly to stop feeding.

The operation of the yarn handling device for adding a new yarn 10*a* to yarn(s) 10 already being fed to a textile apparatus is shown in FIGS. 2A–2E. FIG. 2A shows the resting state for yarn 10*a* with cut end 11. Here nip roll 16 is not in contact with yarn 10*a* or roll 14. First forwarding jet 20 may be on (i.e., has air flowing through it) but the yarn is held by tensioning device 12 to prevent forwarding movement. Guiding means 22 directs the yarn in a straight-line path to the entrance to jet Second jet 24 is off and yarn 10*a* is stationary in guiding means 22.

Figure 2B:
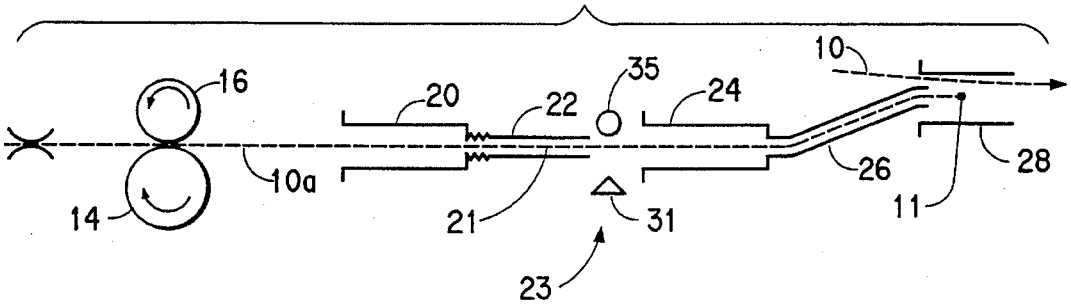
Figure 2C:
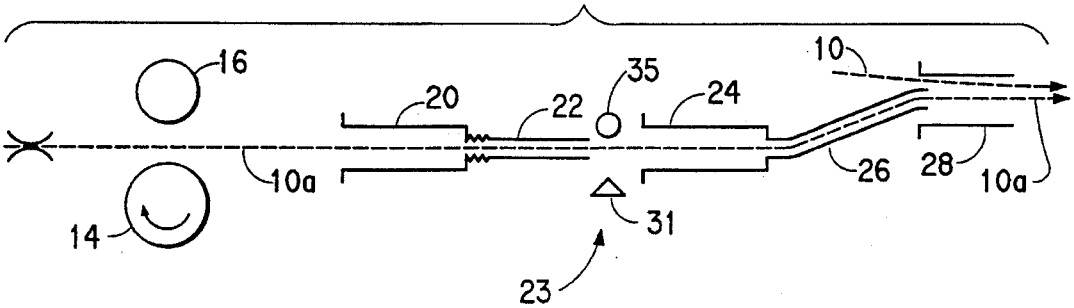

FIG. 2B shows the initial step for adding yarn 10*a*, where nip roll 16 is moved into contact with roll 14 and yarn 10*a* and second forwarding jet 24 is turned on. At this point, the rolls meter the yarn at a controlled rate until the yarn is picked up by the textile process. If first jet 20 was not already on, it is also turned on at this time. This keeps the yarn in an elongated condition as shown by the dashed line instead of buckling and folding back on itself as depicted in line 21. This directs the cut end 11 of yarn 10*a* along a path past cutter 23 and into jet 24. Third forwarding jet 28 is also turned on, and the yarn 10*a* is fed through the jet and on to the subsequent textile processing equipment. Yarn 10*a* also may be drawn along by loose entanglement with yarn 10 that is already being forwarded by the textile processing equipment. In the normal running position, FIG. 2C, nip roll 16 is moved away from roll 14, and the first 20, second 24, and third 28 jets may be turned off. Alternately, one or more of the jets may be left on once the yarn is fed to the textile apparatus.

Figure 2D:
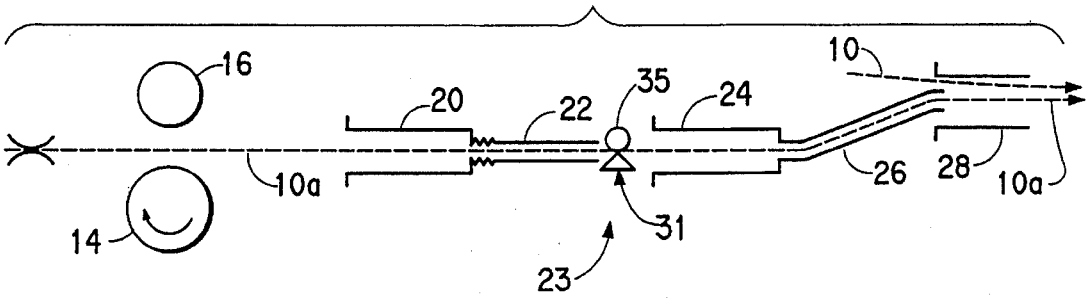
Figure 2E:
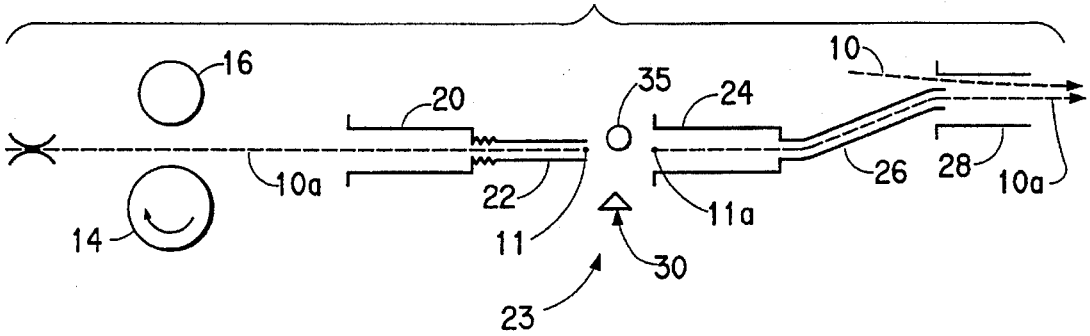

When yarn 10*a* is no longer required by the textile process, high speed cutting device 23 is actuated to cut yarn 10*a* rapidly so no significant tension increase is seen by the textile apparatus or running yarn line 10 that may upset the process. FIG. 2D shows the cutter blade engaging the yarn and FIG. 2E shows the yarn just after cutting where a leading cut end 11 and a trailing cut end 11*a* have been created. The amount of tension developed by cutting without stopping yarn 10*a* is dependent on factors such as the yarn speed, yarn elasticity, yarn length between the cutter blade 31 and the point of engagement of the yarn with the textile process, time for the cutter to sever the yarn 10*a*, etc. For a ply twisted BCF nylon yarn of about 2400 denier traveling at about 45 YPM, cutting with a conventional air actuated blade and anvil cutter did not produce significant tension. The first, second, and third jets 20, 24, and 28, respectively, may each be on or off. In FIG. 2D, cutting blade 31 is moved up to the "cut position." If the third jet 28 was on, it is turned off at this point so that the trailing cut yarn end 11*a* (FIG. 2E)

is not fed too quickly to the subsequent textile apparatus. The cutting blade 31 means is then returned to its resting position in FIG. 2E. Once the trailing cut yarn end 11*a* is fed to the textile process, third jet 28 may be turned on again, if desired. The leading cut end 11 of yarn 10*a* remains in guiding means 22 (FIG. 2E) until such time as it is desired to again feed yarn 10*a* to the textile processing equipment. The tensioner 12 acts to hold the yarn and prevent forwarding movement.

Figure 3A:
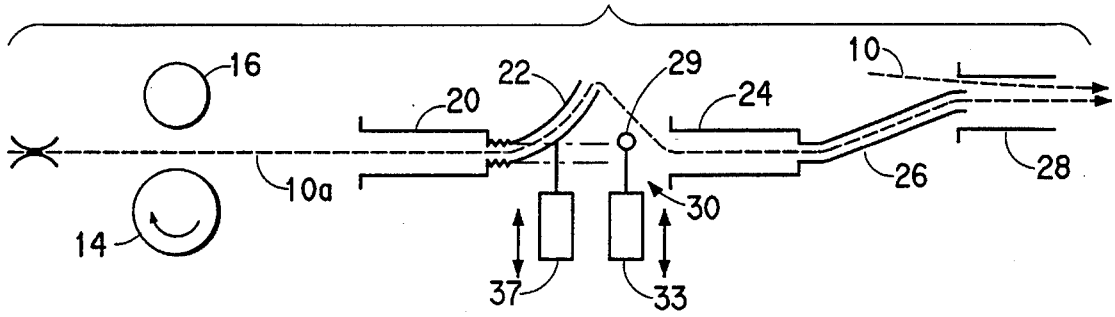
FIGS. 3A–3C schematically illustrate the method of cutting and storing a yarn being fed to the textile operation.
Figure 3B:
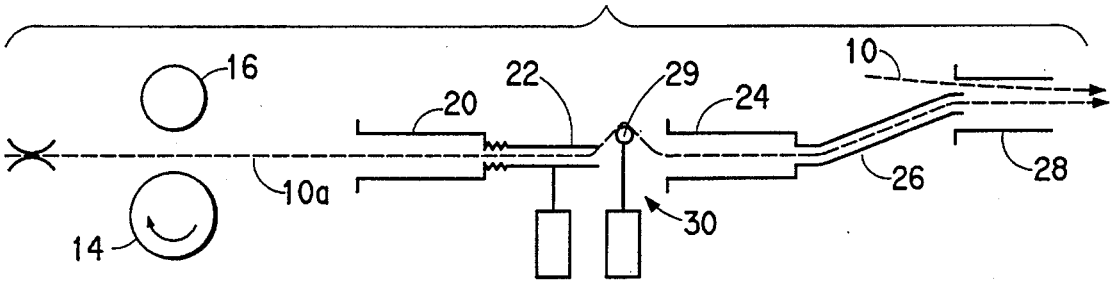
Figure 3C:
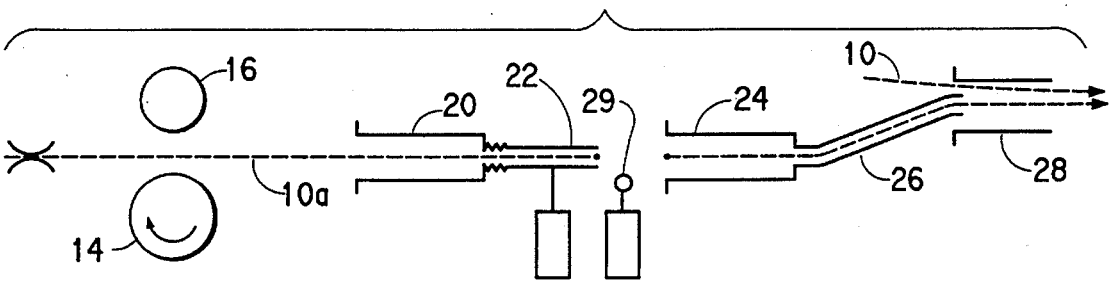

If the yarn speed and yarn tension are considered high and/or it is desired to use a hot wire type of cutter, it has been found advantageous to provide a yarn accumulator so the yarn speed and tension adjacent the cutter can be lowered (i.e. the yarn is made slack) during the cutting step. This accumulation of yarn can be achieved by temporarily providing a yarn path of increased length that is returned to a shorter length at the moment of cutting. In FIG. 3A the yarn 10*a* is running through a guide means 22 that may be a flexible tube or a rigid tube with a bellows located between the ends, and the cutter means 30 is a hot wire 29. Just before it is desired to cut yarn 10*a* to stop feeding it to the textile apparatus, the yarn is deflected to travel in a path of excess length as shown in FIG. 3A. This can be accomplished by a piston actuator 37 bending guide 22 away from the original yarn path. Cutter piston actuator 33 can raise the cutter wire 29 into the original yarn path as shown in FIGS. 3A and 3B. At the moment it is desired to stop feeding yarn 10*a*, the guide 22 provides several functions: a) it directs yarn 10*a* along a path past the cutter toward second forwarding jet 24, (b) it deflects the yarn 10*a* along a path of excess length to provide a small reservoir of yarn that can serve to effectively slow or stop the yarn adjacent the cutter for cutting under low tension, and c) it moves yarn 10*a* over cutting means 30 when it is desired to cut yarn 10*a* and thus stop feeding it to the subsequent textile apparatus. FIG. 3C shows the condition immediately after cutting and after the hot wire 29 has returned to its resting position below the yarn path.

If no slack portion of yarn is provided by the guide means as described and the hot wire is raised into the original yarn path against the running yarn, it is difficult for the wire to heat the fast moving yarn; the moving yarn acts to cool the hot wire without cutting. It has also been found that the hot wire cuts more rapidly if the yarn is slack instead of tensioned.

The technique of providing a path of excess length may be accomplished by other yarn reservoirs or accumulators such as a conventional weft accumulator or the like. The accumulator may also be useful with the blade and anvil type cutter if it is desired to further minimize any tension increase accompanying the cutting that may upset the operation of the textile apparatus. Although the accumulator is shown in FIGS. 3A–3C located upstream of the cutter, it may also be located downstream of the cutter. In particular, if used with a blade and anvil type cutter, it may be located anywhere along the individual yarn path.

For instance, it may be a part of guide tube 26, which may be movable laterally away from and toward the entrance of common jet 28 to provide a path of excess length.

The blade and anvil cutter and the hot wire cutter will both work in the method of the invention as described. The blade and anvil cutter has the advantage of fewer parts and controls, and the hot wire cutter has the advantage of providing a cut end where some of the yarn filaments are fused together so the end does not unravel when handled by the jets in the process; the value of this depends on the tendency for the particular yarn used to unravel, and the cut end quality required in the textile process.

What is claimed is:

1. A method for deleting any individual yarn and reintroducing any individual yarn of a plurality of individual yarns being fed under tension from a plurality of individual sources to a textile process without disrupting the textile process or the other individual yarns, to thereby feed any number and combination of the plurality of yarns to the process, said method comprising:

deleting an individual yarn from the textile process according to the following steps:

cutting an individual yarn, that is being forwarded to the process, rapidly to prevent producing a disruptive tension change in the process or in other yarns being forwarded to the process to produce an upstream cut end of an individual yarn;

holding the upstream cut end of said individual yarn in an elongated condition at a ready position for reintroducing to the process; and reintroducing said yarn at said ready position to the textile process according to the following steps;

metering said individual yarn from said source at a controlled rate;

passing said cut end of yarn with a first individual yarn forwarding jet for forwarding said cut end from said ready position and maintaining said cut end of yarn in an elongated condition during said metering;

directing said elongated, cut end of yarn in a path past an individual yarn cutter;

passing said elongated, cut end of yarn through a guide and a jet means for forwarding said elongated cut end of yarn from said cutter and along an individual yarn path, and maintaining said cut end of yarn in an elongated condition during said passing; and converging said elongated, cut end of yarn with a plurality of individual yarn paths for said plurality of yarns for forwarding said yarn to said textile process.

2. The method of claim 1, wherein said step of passing through a jet means comprises forwarding through an individual yarn forwarding jet.

3. The method of claim 1, wherein said step of passing through a jet means comprises forwarding through a common multiple yarn forwarding jet.

4. The method of claim 1, wherein said step of passing through a jet means comprises forwarding through an individual yarn forwarding jet followed by forwarding through a common multiple yarn forwarding jet.

5. The method of claim 1, wherein said directing step includes directing said yarn along a path of excess length adjacent said cutter.

6. The method of claim 1, wherein passing said yarn along an individual yarn path includes passing said yarn along a path of excess length.

7. A method for deleting any individual yarn and reintroducing any individual yarn of a plurality of individual yarns being fed under tension from a plurality of individual sources to a textile process without disrupting the textile process or the other individual yarns, to thereby feed any number and combination of the plurality of yarns to the process, said method comprising:

deleting an individual yarn from the textile process according to the following steps:

cutting an individual yarn, that is being forwarded to the process, rapidly, to prevent producing a disruptive tension change in the process or in other yarns being forwarded to the process to produce an upstream cut end of an individual yarn;

holding the upstream cut end of said individual yarn in an elongated condition at a ready position for reintroducing to the process; and reintroducing said yarn at said ready position to the textile process according to the following steps;

metering said individual yarn from said source at a controlled rate;

passing said cut end of yarn with a first individual yarn forwarding jet for forwarding said cut end from said ready position and maintaining said cut end of yarn in an elongated condition during said metering;

directing said elongated, cut end of yarn in a path of excess length adjacent an individual yarn cutter;

passing said elongated, cut end of yarn through a guide and a jet means for forwarding said elongated cut end of yarn from said cutter and along an individual yarn path, and maintaining said cut end of yarn in an elongated condition during said passing; and converging said elongated, cut end of yarn with a plurality of individual yarn paths for said plurality of yarns for forwarding said yarn to said textile process.

8. The method of claim 7, including the step of rapidly redirecting the yarn from said path of excess length to said path past said cutter, and placing said cutter in said path to cause said yarn to be slack and be cut by said cutter.

9. A method for deleting any individual yarn and reintroducing any individual yarn of a plurality of individual yarns being fed under tension from a plurality of individual sources to a textile process without disrupting the textile process or the other individual yarns, to thereby feed any number and combination of the plurality of yarns to the process, said method comprising:

deleting an individual yarn from the textile process according to the following steps:

cutting an individual yarn, that is being forwarded to the process, rapidly to prevent producing a disruptive tension change in the process or in other yarns being forwarded to the process to produce an upstream cut end of an individual yarn;

holding the upstream cut end of said individual yarn in an elongated condition at a ready position for reintroducing to the process; and reintroducing said yarn at said ready position to the textile process according to the following steps;

metering said individual yarn from said source at a controlled rate;

passing said cut end of yarn with a first individual yarn forwarding jet for forwarding said cut end from said ready position and maintaining said cut end of yarn in an elongated condition during said metering;

directing said elongated, cut end of yarn in a path past a hot wire yarn cutter;

passing said elongated, cut end of yarn through a guide and a jet means for forwarding said elongated cut end of yarn from said cutter and along an individual yarn path of excess length, and maintaining said cut end of yarn in an elongated condition during said passing; and converging said elongated, cut end of yarn with a plurality of individual yarn paths for said plurality of yarns for forwarding said yarn to said textile process.

10. The method of claim 9, including the step of rapidly redirecting the yarn from the path of excess length to said individual yarn path at the moment of cutting to cause the yarn to be slack during cutting.

* * * * *